US006223861B1

(12) United States Patent
Sansevero

(10) Patent No.: US 6,223,861 B1
(45) Date of Patent: May 1, 2001

(54) ELEVATOR HOISTWAY ACCESS SAFETY

(75) Inventor: Frank M. Sansevero, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/385,535

(22) Filed: Aug. 30, 1999

(51) Int. Cl.[7] ..... B66B 13/14
(52) U.S. Cl. ..... 187/316; 187/391
(58) Field of Search ..... 187/316, 279, 187/280, 288, 317; 49/25, 26; 318/466–469, 286

(56) References Cited

U.S. PATENT DOCUMENTS 3,831,715 * 8/1974 Matsuzawa et al. ..... 187/29 R
4,367,810 * 1/1983 Doane et al. ..... 187/280
4,936,419 * 6/1990 Stadler ..... 187/133
5,476,157 * 12/1995 Todaro ..... 187/280
5,549,179 * 8/1996 Herkel et al. ..... 187/298
5,644,111 * 7/1997 Cerny et al. ..... 187/393
5,780,788 * 7/1998 Eschenbrenner et al. ..... 187/316
6,138,798 * 10/2000 Macuga ..... 187/294

FOREIGN PATENT DOCUMENTS

984556 * 2/1965 (EP) ..... 187/280

* cited by examiner

*Primary Examiner*—Jonathan Salata

(57) ABSTRACT

The condition of the hoistway doors and the elevator door are continuously monitored. The opening of a hoistway door unaccompanied by opening of the car door being an indication of hoistway access; the car then is moveable only at inspection (slow) speed by utilizing controls on the car top; restoration to normal is achieved only by returning the inspection switch on the car top to normal operation while a hoistway door is open, and subsequently closing the hoistway doors and/or by activating a reset located outside the hoistway. Inspection speed limit switches are installed near the top and bottom of the hoistway positioned so that if operated while the elevator is traveling at inspection speed, the car will stop at a position which leaves a person ample room from the hoistway overhead or the pit floor. If a person enters the pit, normal operation is restored only by closing the hoistway door and subsequently engaging an external reset switch (outside the hoistway).

7 Claims, 2 Drawing Sheets

ELEVATOR HOISTWAY ACCESS SAFETY

TECHNICAL FIELD

This invention relates to recognizing when a person has made access to an elevator hoistway other than into a car, and controlling elevator operation for safety.

BACKGROUND ART

Persons that enter a hoistway, such as elevator mechanics, building maintenance personnel, and unauthorized persons such as vandals, may suffer serious and fatal accidents when the elevator moves unexpectedly at normal speed. Such accidents most commonly occur in the overhead or the pit where the person is crushed by the sudden movement of the elevator. This problem is aggravated in systems in which the hoisting machine and/or the controller are located in the pit. As architects continue to try to reduce the size of the overhead and the depth of the pit, the problem becomes even worse.

Heretofore, elevator systems have not made provision to recognize when persons have entered the hoistway, relying instead on the mechanic moving an inspection switch from the normal mode of operation position to the inspection mode of operation position. This is typically achieved when the elevator is parked at one floor, the mechanic forces the hoistway doors open on the next higher floor, the mechanic thereupon enters the hoistway on the roof of the cab, and usually transfers the inspection switch from the normal mode of operation to the inspection mode of operation, and then controls the motion of the cab by means of switches on the inspection box. When the mechanic returns the maintenance switch to the normal mode of operation, the hoistway door switch may be shorted out or defective so it appears that the safety chain is made, or if the mechanic failed to put the inspection switch into the inspection mode, the elevator may start up for some reason, which has resulted in crushing the mechanic between the top of a car and the sill of the hoistway door.

A partial solution to this known to the prior art is requiring a sequence including that a hoistway door shows as being open, followed by the stop switch being in the stop position, then the inspection switch being transferred to normal, and then the hoistway doors all being closed. However, this still does not inform the system when someone has entered the hoistway in the first place, which is still only learned when the inspection switch is transferred to the inspection mode, whereby any mechanics within the hoistway are at risk of being crushed. Furthermore, none of these systems detect the case when the mechanic enters the pit (where he cannot activate the inspection switch).

DISCLOSURE OF INVENTION

Objects of the invention include detecting any entry of personnel into an elevator hoistway, whether it be in the pit or in the overhead; substantially eliminating the possibility of a person being crushed by unexpected movement of the elevator when operating either at inspection speed or normal speed; providing safety in systems which utilize reduced overhead and/or pit dimensions for traditional as well as machine-room-less elevators; providing a hoistway access control that is sufficiently safe so as to achieve regulatory code approval.

According to the present invention, the condition of the hoistway doors and the elevator door are continuously monitored; the opening of a hoistway door unaccompanied by opening of the car door being an indication of hoistway access; the car then is moveable only at inspection (slow) speed by utilizing controls on the car top; restoration to normal is achieved only by either returning the inspection switch on the car top to normal operation while a hoistway door is open, and then closing the hoistway doors, or engaging an external reset (outside the hoistway) while the landing doors are all closed, or a combination of both. In accordance further with the invention, inspection speed limit switches are installed near the top and bottom of the hoistway positioned so that if operated while the elevator is traveling at inspection speed, the car will stop at a position which leaves a person ample room (over six feet) from the hoistway overhead or the pit floor.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
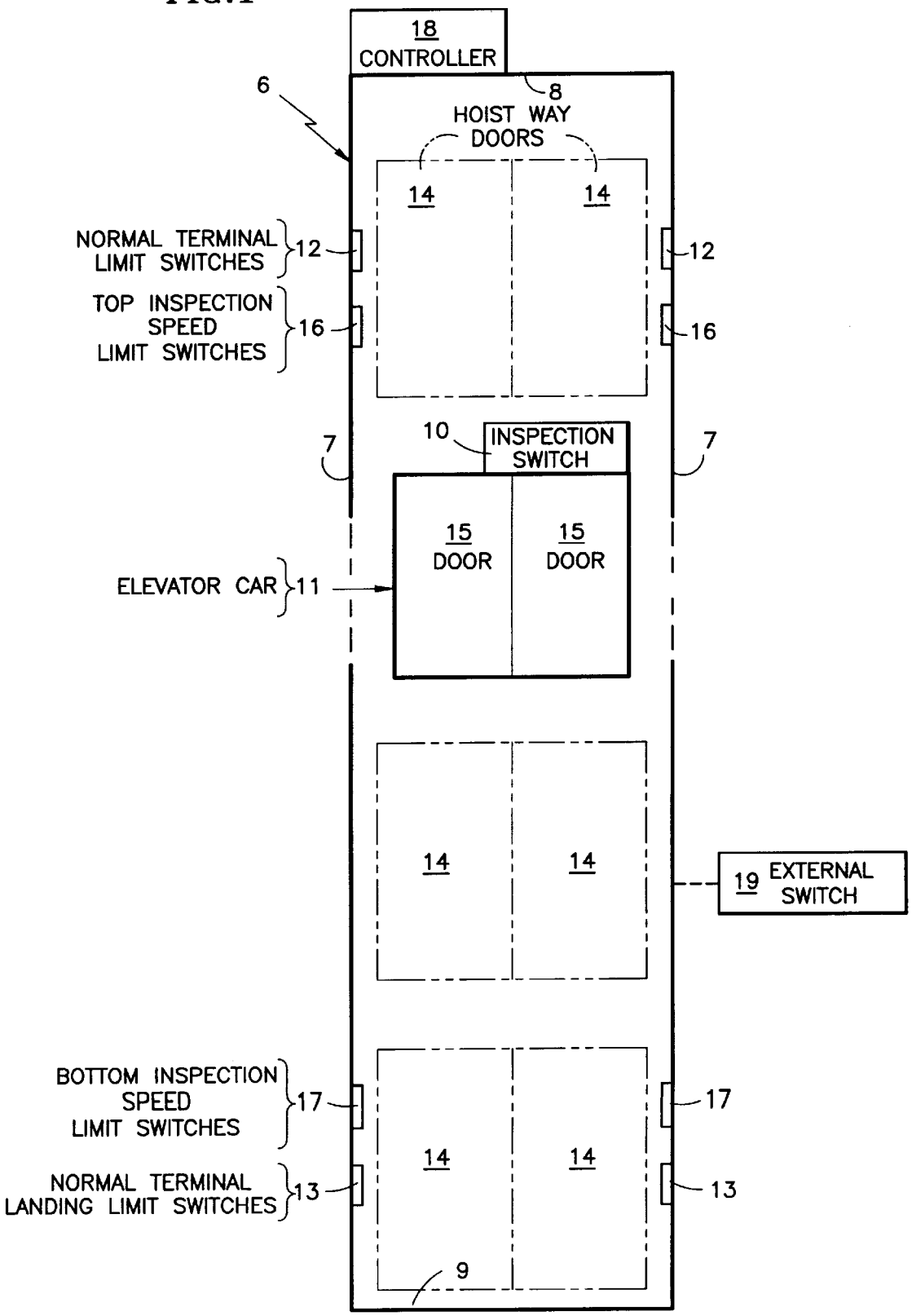
FIG. 1 is a simplified outline of an elevator hoistway illustrating positioning of normal and inspection speed limit switches.

Referring now to FIG. 1, the outline 6 of an elevator shaft includes sidewalls 7, the overhead 8, and the floor of the pit 9. An inspection switch 10 is disposed on top of an elevator car 11. The hoistway includes top, normal terminal landing limit switches 12, bottom normal terminal landing limit switches 13, and in accordance with the invention, top inspection speed limit switches 16, and bottom inspection speed limit switches 17. The elevator has a controller 18 and an external switch 19 not accessible by a person within the hoistway.

Figure 2:
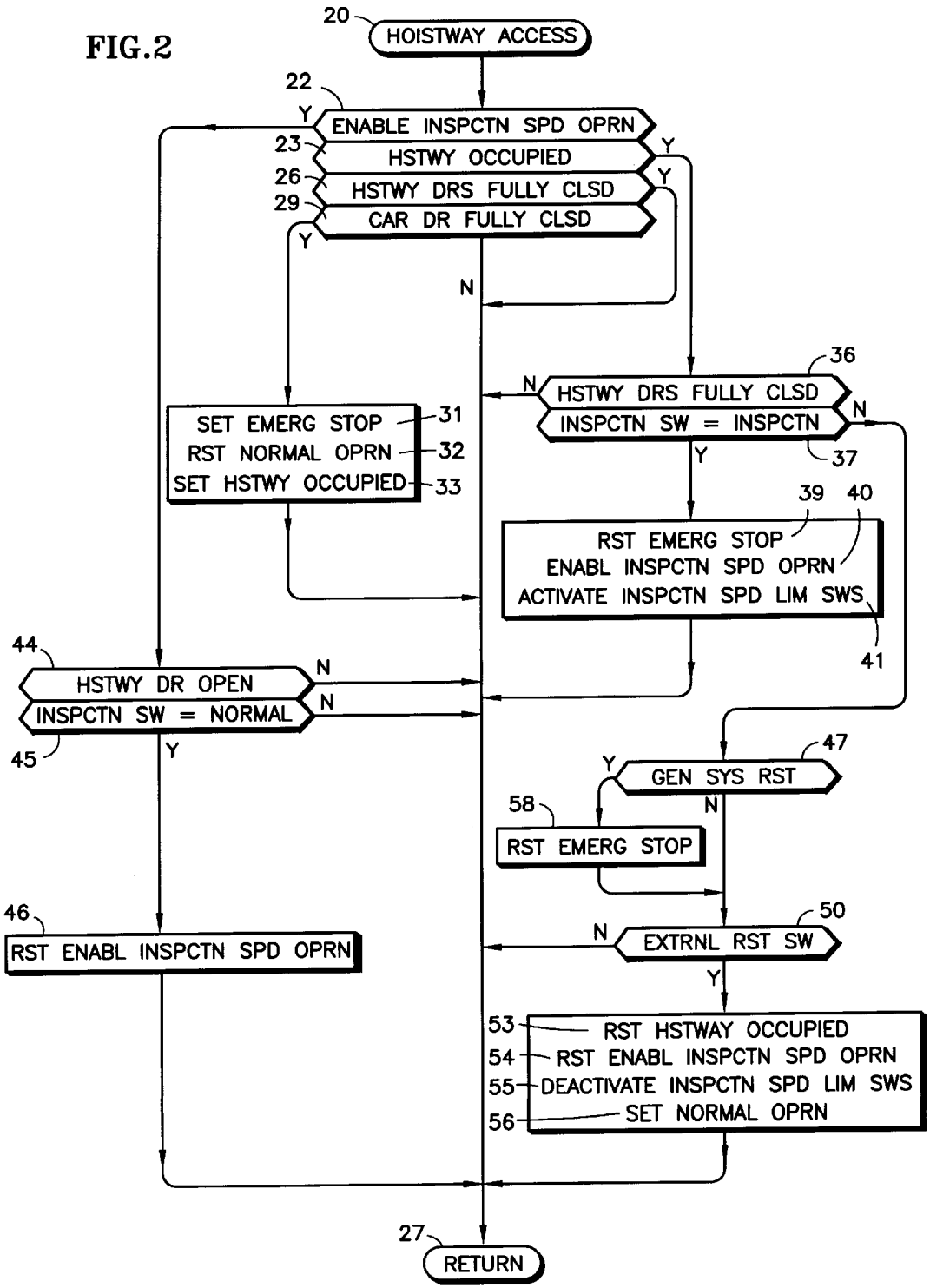
FIG. 2 is a high level flow diagram of functions which may be performed in practicing the present invention.

Referring to FIG. 2, a hoistway access routine is entered periodically through an entry point 20; each of the first two tests 22, 23 relates to a particular local logic flag which is described hereinafter. Each of the tests 22, 23 is normally negative, when the elevator is operating normally without any access to the hoistway having been made, reaching a test 26 to see if all of the hoistway doors 14 are fully closed. If they are, there is no access being gained, so an affirmative result will reach a return point 27 through which other programming is reached. However, if the hoistway doors 14 are not fully closed, then a test 29 determines if the car door 15 is also not fully closed. If it is not, that means that the car door 15 is opening the hoistway door 14 in the usual fashion, which is normal and safe, so a negative result of test 29 causes other programming to be reverted to through the return point 27. However, if the hoistway doors 14 are not all fully closed while the car door 15 is fully closed, hoistway access is indicated, so an affirmative result of test 29 reaches a step 31 to set emergency stop (which of course may be limited so that it will take place only if the elevator is moving); a step 32 to reset normal operation, so that the elevator cannot resume ordinary operation except as described hereinafter; and a step 33 to set a hoistway occupied flag which will require use of the inspection controls, or an external switch before normal operation can resume. And then other programming is reached through the return point 27. In this condition, it is assumed that the elevator is disabled (no normal operation) and in reaching that state, the brake has fully engaged.

In a subsequent pass through the routine of FIG. 2, test 22 will still be negative, but now test 23 will be affirmative since the hoistway occupied flag was set at step 33. Therefore, a test 36 will determine if the hoistway doors 14 have been closed, or not. If not, other programming is reached through the return point 27 and the car remains at emergency stop. Normally, if a mechanic is going to step out onto the overhead of the elevator and thereafter work the inspection controls, he will generally set the normal/inspection switch to inspection, and the run stop switch to stop, after which he will short-circuit the hoistway doors 14 so that they will appear to be closed to the safety chain, thereby allowing the car to move, while actually remaining open. Once this has happened, in a subsequent pass through the routine of FIG. 2, test 36 will be affirmative reaching a test 37 which determines if the inspection switch has been switched from normal operation to inspection operation. If so, an affirmative result of test 37 reaches a series of steps 39-41 to reset the emergency stop, enable inspection speed operation, and activate the inspection speed limit switches, so that contact of the switches will result in a conventional, limit-switch-stopping of the elevator, should it reach upper or lower limits. Then other programming is reached through the return point 27. At this point, the mechanic will probably move the elevator up and down and perform other tasks. Eventually, the mechanic will finish what he is doing and remove the shunts on the hoistway door switches.

In a subsequent pass through the routine of FIG. 2, test 22 will now be affirmative reaching a test 44 to determine if a hoistway door 14 is open. This is to test for the mechanic removing the door switch shunt so the system can believe a subsequent indication that the doors are closed. If no hoistway door 14 is open, other programming is reached through the return point 27; but if any hoistway door 14 is open, then a test 45 determines if the inspection switch is set to normal, or not. The procedure requires that to return to normal operation, the hoistway door 14 be opened and the inspection switch returned to normal while the hoistway door 14 is still open. If the inspection switch has not been moved to normal, a negative result of test 45 causes other programming to be reached through the return point 27. When the inspection switch is transferred to normal while a hoistway door 14 is open, a step 46 resets enable inspection speed operation, and then other programming is reached.

In a subsequent pass through the routine, test 22 is now negative, but test 23 is still affirmative, reaching the test 36 to see if the hoistway doors 14 are now all fully closed, if not, other programming is reverted to. Presumably, once the mechanic returns the switch to normal and steps off the elevator through the hoistway door 14, he will close the hoistway doors. If all of the hoistway doors have been closed, a negative result of test 36 reaches test 37; presumably, the inspection switch is no longer set to inspection, so a negative result of test 37 reaches a test 47 to determine if a general system reset has occurred. In the usual case, it will not and a negative result of test 47 reaches a test 50 which determines if a reset switch mounted externally of the hoistway has been operated or not. If not, the system remains in the "hoistway occupied" mode. When the doors are closed and the external switch has operated, a series of steps 53–56 will reset the inspection flag, reset the enabling of inspection speed operation, deactivate the inspection speed limit switches (whether or not they were activated), and set normal operation. Now the elevator is restored and can operate in a normal fashion.

When a mechanic enters the pit, he will normally open a hoistway door 14 and leave it open, so the safeties prevent the elevator from running. This will cause a negative result of test 26 and an affirmative result of test 29 to reach the steps 31–33 so that the system will be in the "hoistway occupied" mode. However, an affirmative result of test 23 in a next pass will reach a negative result of test 36. This will continue until the mechanic leaves the pit and closes the hoistway door 14. Then an affirmative result of test 36, a negative result of test 37, a negative result of test 47 and an affirmative result of test 50 is the way in which the mechanic will restore normal operation once he leaves the pit. If desired, the use of the external reset switch, test 50, can be eliminated in the case where the mechanic is on the overhead, and utilizing the inspection switch. However, in the best mode, the external switch will be used both when the mechanic enters the overhead and when he enters the pit.

In the event that vandals have entered the hoistway, and never follow the sequence set forth in the tests 36 and 37, it is possible that maintenance personnel will require setting a general system reset, once the hoistway doors are fully closed, whether or not the inspection switch is transferred. This occurs when an affirmative result of test 47 resets emergency stop in a step 58; the routine then proceeds to the steps 53–56 to restore normal operation as described hereinbefore.

The embodiment described with respect to FIG. 2 utilizes both a sequence which includes moving the inspection switch to normal (test 45) while the hoistway door 14 is open (test 44) and then causing the hoistway doors 14 to be fully closed (test 36), as well as requiring the external reset switch. If desired, the invention may be practiced simply by using the tests 44, 45 and 36 without the test 50.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A method of providing hoistway access safety in an elevator system having a car with a door and having a hoistway with a plurality of hoistway doors, comprising:

monitoring continuously the open/closed status of all of said hoistway doors and said car door;

in the event that one of said hoistway doors is not fully closed contemporaneously with said car door being fully closed, causing an emergency stop of said car, if necessary, and terminating normal operation of the elevator;

in the event said hoistway doors are all fully closed and an inspection switch on said car has been set into an inspection operation mode position, eliminating the emergency stop and enabling operation in an inspection operation mode; and, if operation in an inspection operation mode has been enabled, then, in response to said inspection switch being placed in a normal operation mode position while at least one of said hoistway doors is open, followed by all of said hoistway doors being closed, causing said elevator to resume normal operation.

2. A method according to claim 1 further comprising:

in response to all of said hoistway doors being closed, said inspection switch being in a normal operation mode position, and a switch external of said hoistway being actuated, causing said elevator to resume normal operation.

3. An elevator system in a building comprising:

a hoistway having a plurality of hoistway doors;

a car moveable in said hoistway and having a door to provide access to said car through any of said hoistway doors;

an inspection switch disposed on said car and operable to transfer said car between a normal operating mode and an inspection operating mode; and signal processing means for monitoring the open/closed status of all of said doors, and responsive to one of said hoistway doors not being fully closed when said car door is fully closed, to cause an emergency stop of said car and terminating normal operation thereof; responsive to said inspection switch to place said car in an inspection operation mode; and, responsive to said inspection switch being set in its normal operating mode position contemporaneously with one of said hoistway doors open, followed by all of said hoistway doors being closed, to place said car in a normal operation mode.

4. An elevator system according to claim 3 further comprising:

an external switch disposed in said building at a point where it is not accessible by a person in said hoistway; and wherein said signal processing means comprises means responsive to operation of said external switch contemporaneously with all of said hoistway doors being closed to place said car in a normal operation mode.

5. A system according to claim 3 further comprising:

a plurality of inspection speed limit switches positioned in said hoistway so that actuation thereof by said elevator when operating in said inspection operation mode will cause said elevator to stop at a distance from either terminal end of said hoistway which is safe for persons which may be between the elevator and such terminal end.

6. A method of providing hoistway access safety in an elevator system having a car with a door and having a hoistway with a plurality of hoistway doors, comprising:

monitoring continuously the open/closed status of all of said hoistway doors and said car door;

in the event that one of said hoistway doors is not fully closed contemporaneously with said car door being fully closed, causing an emergency stop of said car, if necessary, and terminating normal operation of the elevator;

in the event said hoistway doors are all fully closed and an inspection switch on said car has been set into an inspection operation mode position, eliminating the emergency stop and enabling operation in an inspection operation mode;

providing inspection speed limit switches positioned in said hoistway so that actuation thereof by said elevator when operating in said inspection operation mode will cause said elevator to stop at a distance from either terminal end of said hoistway which is safe for persons which may be between the elevator and such terminal end; and activating said inspection speed limit switches in response to said inspection switch being in said inspection operation mode position.

7. A method according to claim 6 further comprising:

in response to all of said hoistway doors being closed, said inspection switch being in a normal operation mode position, and a switch external of said hoistway being actuated, causing said elevator to resume normal operation.

* * * * *